United States Patent [19]

Forestier et al.

[11] Patent Number: 4,731,223

[45] Date of Patent: Mar. 15, 1988

[54] COMPOSITION FOR AUTOMATIC CLEANING OF TOILET BOWLS

[75] Inventors: Lucienee Forestier, Paris; François-Xavier Bonnet, Velizy; Alain Lacroix, Jouy en Jucas, all of France

[73] Assignee: Cotelle S.A., Boulogne-Billancourt, France

[21] Appl. No.: 797,182

[22] Filed: Nov. 8, 1985

Related U.S. Application Data

[63] Continuation of Ser. No. 627,865, Jul. 5, 1984, abandoned.

[30] Foreign Application Priority Data

Jul. 8, 1983 [FR] France ..... 83 11845

[51] Int. Cl.[4] ..... E03D 9/02

[52] U.S. Cl. ..... 422/37; 252/544; 252/547

[58] Field of Search ..... 252/547, 98, 99, 107, 252/117, 544; 422/37

[56] References Cited

U.S. PATENT DOCUMENTS

| | | | |
|---|---|---|---|
| 3,504,384 | 4/1970 | Radley | 4/228 |
| 3,819,528 | 6/1974 | Berry | 252/544 |
| 3,876,551 | 4/1975 | Laufer et al. | 252/98 |
| 4,200,606 | 4/1980 | Kitko | 422/37 |
| 4,229,313 | 10/1980 | Joy | 252/98 |
| 4,248,827 | 2/1981 | Kitko | 252/DIG. 16 |
| 4,276,205 | 6/1981 | Ferry | 252/547 |
| 4,282,109 | 4/1981 | Citrone et al. | 252/98 |
| 4,420,412 | 12/1983 | Wong | 252/98 |

FOREIGN PATENT DOCUMENTS

| | | |
|---|---|---|
| 2529598 | 1/1984 | France . |
| 1219200 | 1/1971 | United Kingdom . |

*Primary Examiner*—Paul Lieberman
*Assistant Examiner*—John F. McNally
*Attorney, Agent, or Firm*—Karl F. Ross; Herbert Dubno; Jonathan Myers

[57] ABSTRACT

A composition for the automatic cleaning of toilet bowls includes at least one amine oxide, at least one appropriate colorant and at least one pH regulating agent, the composition being such that the pH of the aqueous mixture in the toilet bowl is about 6.3±0.5. The composition is applied by filling containers designed to be used especially in the reservoir or tank of the toilet bowl.

2 Claims, No Drawings

COMPOSITION FOR AUTOMATIC CLEANING OF TOILET BOWLS

This is a continuation of application Ser. No. 627,865, filed July 5, 1984 and now abandoned.

FIELD OF THE INVENTION

The present invention relates to a product for the automatic cleaning of toilet bowls. More particularly the product is to be distributed in the water used in flushing the toilet and may be added to the tank or reservoir of the toilet. Less advantageously the product may be simply added to the toilet bowl.

BACKGROUND OF THE INVENTION

The periodic cleaning of a toilet bowl is traditionally done apart from a strong flushing with water with the help of a scale-removing acid product, which is used once or several times a week. There also exist block form cleaning agents for automatic cleaning of the toilet bowl, designed to be used in the toilet bowl or tank. These blocks principally contain a perfume and a colorant and are contained in the siphon water of the bowl and exert only a weak cleaning ability because of the great dilution of the active material which they liberate into the flushing water.

In order to obtain a better cleaning of the toilet bowl, there exist cleaning products designed to be placed in the toilet tank or the flushing water and which only deliver the treatment product at the end of each emptying of the bowl. Such arrangements are described for example in British Pat. No. 1,219,200 as well as in French patent application No. 82 12 037 filed in the names of the applicants. These cleaning products can be introduced with a distributor at a slightly elevated temperature. These products are compositions which must be pumpable at a temperature higher than ambient temperature and which become solid again at ambient temperature. The products are added in the form of a pellet, a block, or in any other solid form, preferably prepared by pressing, by extruding, or by any other appropriate technique. In practice the product is constituted by cleaning agents, at least one charge of colorant, perfumes and emulsifying agents.

It is known to incorporate in a scented block for cleaning, a compound which liberates hypochlorite, which is a disinfectant, and which also possesses a strong ability to bleach. In such a case the solution appearing in the tank would be a neutral or basic solution.

Though the cleaning blocks described above if they mix effectively with the siphon water have a pleasant color, they exert only a weak cleaning action. They are not inhibited by the waste deposited on the surface of the bowl and especially the siphon of the bowl. But the movement of the water flowing down into the toilet bowl is insufficient to eliminate the waste, even if the water contains a well-reputed cleaning agent liberated by the block.

Additionally when the liquid medium within the toilet bowl and its siphon at the end of each flush is neutral or basic, it is verified that the colorant in the mixture is attracted to the walls of the bowl and streaks or traces of dye are observed.

Furthermore, when the cleaning compositions for toilet bowls which are designed to be incorporated in a device for the toilet bowl tank and the flushing water, contain an oxygenated disinfectant, the colorant must be a particular color, pure and not of a technical grade so that the coloration of the liquid medium in the siphon is stable in the presence of the oxidants, which must also be there.

OBJECTS OF THE INVENTION

The object of the invention is to provide a composition for the automatic cleaning of toilet bowls.

The composition must have a coloration suitable and stable in the siphon water within the toilet bowl, even when the aqueous mixture in the bowl contains a hypochlorite compound.

The composition must assure effective cleaning of the bowl as well as disinfecting.

The composition must not leave traces of colorant on the walls of the bowl.

The composition must be effective enough to disperse as a general rule as a complement to manual cleaning.

The composition must be easy to apply.

SUMMARY OF THE INVENTION

The compositions according to the present invention comprise at least one amine oxide, at least one appropriate colorant, and at least one agent to regulate the pH, the composition having to be such that the pH of the aqueous mixture in the toilet bowl is maintained at about $6.3 \pm 0.5$.

It was totally unexpected that an amine oxide in a slightly acidic medium corresponding to the abovementioned pH range, permits the obtention of this kind of surface treatment.

In effect, it can be reasonably stated that because of the opposite electric charges between the porcelain and the amine oxide, the latter can be fixed on the walls of the bowl and result in a suitable coating to prevent fecal material from adhering to the walls of the bowl. If one operates so that the aqueous mixture in which the colorant is dispersed is neutral or alkaline, one notices that the colorant is attracted to the walls of the bowl and one observes streaks or traces of colorant on the bowl. If the mixture is acid, according to the present invention, the colorant does not have the same affinity for the walls of the bowl, when an amine oxide is distributed throughout the mixture. Provided that these explanations would be given only where a titer of hypochlorite is present, one supposes that in an acid medium containing an amine oxide the latter would react as a cationic component. Conversely in a neutral or basic medium the repulsion of the charges would be different and would favor adherence of the colorant to the walls of the bowl. This is all especially true with the colorant Blue Ocean W as well as with the blue commercial colorant of the Hoechst Corporation, designated DUASYIN ACID BLUE A E, which are the preferred colorants; these colorants possess in their molecule a negative charged sulfonate radical and a positively charged nitrogen atom and the affinity of these colorants for the toilet bowl differs according to the pH.

The chosen pH is around 6.5 and more precisely $6.3 \pm 0.5$. As indicated above, there is a supplemental advantage when the composition according to the invention is utilized in association with or in conjunction with a supplier of hypochlorite ions. It is necessary to note that in each case, the supplier of hypochlorite ions (or chlorite disinfectant) is not initially, on dissolving, in physical contact with the composition according to the invention, and proceeds in an appropriate manner. At a certain pH, the equilibrium hypochlorite-hypochlorous acid is displaced in favor of the acid.

But while it is known that hypochlorite has a good ability to bleach that is superior to that of the acid, it is also true that the acid is more active as a bactericide.

The recommended pH of the present invention is indeed doubly favorable in the considered field of application, since it is desirable to employ a pH at which the composition is an effective bactericide while at the same time the pH must not be harmful to the colorant. Additionally one does not have to contend with the eventual liberation of chlorine which is produced only at a pH less than 3.

Advantageously the composition according to the invention is in the form of a block which is obtained by molding a solidifiable, fluid composition and solidification preferably by chilling, by pressing, by extruding or by all of these methods. In each case the composition contains, besides the functional components indicated hereinabove to be essential, components to control charge and/or components necessary according to circumstances to obtain the desired fusibility, hardness, solubility and plasticity.

The additional appropriate components can be chosen on the basis of convenience by the ordinary skilled worker in the art.

According to a preferred feature, the composition further comprises at least one additional compound different from the amine oxide and/or at least one anionic compound and/or perfume.

Thus there can be utilized as a substrate for foming a block of the abovementioned composition, an anionic detergent such as for example an alkyl benzene sulfonate (ABS), a paraffin sulfonate (PS), and/or a methyl ester of a fatty acid sulfone.

The product may contain besides the abovementioned anionic detergents, any other suitable anionic detergent. Furthermore as the anionic detergent, there may be a single compound, or a mixture of two or more compounds.

More advantageously one can combine in proportions wellknown to those "skilled in the art" or readily ascertained by those "skilled in the art" with the anionic detergent, at least one additional nonionic detergent, preferably at least one polyethylene glycol (PEG) having a molecular weight between about 10,000 and 100,000, and more particularly between 10,000 and 50,000. The combination of the anionic and nonionic compounds forms a substrate into which one incorporates by classic means, the amine oxide, the colorant and the pH regulating agent.

The disinfectant product is preferably a chlorine-containing disinfectant which can be used together with the active composition according to the invention and which can be chosen especially from the hypochlorites of alkali metals, alkali earth metals, trichloro isocyanuric acid, dichloroioscyanurates of sodium or potassium, chloramine and analogs.

In practice the composition according to the invention includes in the appropriate physical form a distributor means or container designed to automatically deliver an appropriate amount of the active ingredients of the composition to cover each part of the flushing process. The distributor means or container may be placed in the toilet bowl but is preferably placed in the toilet tank.

The means of distribution is for example of the type described in French Pat. No. 82 12 037 filed in the name of applicants. It is only a question of which form to use when applying the particular composition according to the invention. Placing the composition in the distribution device can be done directly at moderate, high or ambient temperatures using a composition flowable at such temperatures by introduction of a solid tablet preferably formed by pressing, extruding or by flowing into a mold or by other appropriate techniques.

In one example a flowable mass can be obtained which is solidifiable upon cooling containing a composition according to the present invention. At about 70° C., a paraffin sulfonate in the form of chips is treated to form a paste and then incorporated into a mixture containing the active ingredients according to the invention. The homogeneous composition thus formed is solidified, and cooled in the chamber of a distribution device.

The following descriptions given concern the essential and optional ingredients of the invention.

Amine Oxide

The amine oxides are nonionic compounds which have a cationic tendency in an acid medium. Specifically the tertiary amine oxides according to the formula:

$$R_1R_2R_3N \rightarrow 0$$

where $R_1$ is an alkyl group having 8 to 20 carbon atoms and $R_2$ and $R_3$ are each methyl or ethyl, are contemplated. A preferred species is dodecyl-dimethyl-amine oxide.

The amine oxides can be employed in a water solution or in a mixture of water and alcohol (e.g. isopropyl alcohol) usually in a concentration of about 30% by weight.

The preferred proportion of amine oxide in the composition according to the invention is about 3% by weight in relation to the total weight of active ingredients in the composition.

Concerning the eventual action of the amine oxide on hypochlorous acid between two successive usages of the bowl and the flushing water, it must be noted that the concentrations of hypochlorous acid are too weak (ppm) in order to be able to determine within precise limits the exact concentration. It can be said that the concentration varies little within 24 hours and that the cleaning composition also fills its role as a disinfectant without any appearance of antagonism between the various components in the composition.

Colorant

The colorants utilized must first of all be chosen on the basis of their stability.

For the type of use in the present invention, blue colorants have generally been employed. Such colorants include those of the families of the phthalocyanines or triaryl methanes. Thus the blue colorants C 142090 and 42045 have been largely utilized for a long time and it is known that their coloration remains stable even in the case for the local water supply where the public toilets has been chlorinated. It can be seen in U.S. Pat. No. 3,355,392 that the colorant FD & C Blue No. CI 42 090 is among the blue colorants, the one that is most stable in the presence of any of the oxidants.

It can be stated that when the cleaning compositions are those of the present invention, it is not necessary to use colorants that are highly pure. For applications of this type it is sufficient to use for example Blue Ocean W sold by WACKHERR or DUASYN ACID BLUE A E sold by Hoechst, and used under normal conditions are satisfactorily stable. These characteristics are especially interesting from the point of view of economy.

The good stability of the colorant according to the invention can be attributed to several factors:

First, it has been discovered that the good stability arises from the adjustment of the pH of the siphon water of the toilet to a value between 5 and 7, especially around 6.5.

Second, the composition seems to exert an inhibiting action vis-a-vis the impurities which play a catalytic role in the oxidation by the chlorine-containing ions.

In practice it is suitable to use between 1 and 10%, preferably between 2 and 3% by weight of a powdered colorant (40–60% active ingredient therein) in relation to the total amount of the composition.

pH Regulator

The pH regulation is an essential element of the composition since it has been found that the cleaning and coloring properties which result from the combination of the three constituents: amine oxide, colorant, and pH regulating agent all take precedence.

Although nonlimiting the preferred products to be used as pH regulators can be chosen from among the following:

(a) sodium salts of orthophosphoric acid:

sodium pyrophosphate ($Na_4P_2O_7$) of which the pH of a 1% solution is 10.2, disodium orthophosphite ($Na_2HPO_4$) of which the pH of a 1% solution is 9.1, sodium biphosphate ($NaH_2PO_4$ $H_2O$) of which the pH of a 0.1N solution is 4.5, trisodium orthophosphate ($Na_3PO_4$ $12H_2O$) of which the pH of a 1% solution is 11.9, and disodium dihydrogen phosphate ($Na_2H_2P_2O_7$) of which the pH of a 1% solution is between 4.0–4.3, (b) sodium dihydrogen citrate, or mixtures of the above compositions, or more generally any acid salt or mixture capable of adjusting the pH of the siphon water of the toilet bowl to a value of 6.3±0.5, preferably 6.5.

In practice it is advantageous to incorporate between 8–12% by weight of a pH regulating agent in the composition, and preferably about 10% by weight in relation to the total weight of the composition. Below about 8% the amount introduced is insufficient to exert the proper influence, and above 12% the usefulness diminishes and disturbances will occur.

Anionic Surfactant

When the anionic surfactants are incorporated in the composition, essentially it is to formulate a solid composition. Essnetially any known or available anionic surfactant can be used, alone or in a mixture. Examples include alkyl benzene sulfonates, lauryl ether sulfonates, alpha-olefin sulfonates, paraffin sulfonates, and their mixtures.

Particularly preferred are the alkylbenzene sulfonates, and the paraffin sulfonates together in a mixture with soap.

In practice, the proportion of anionic surfactant varies between 0 and 65% by weight with respect to the total weight of the composition. The preferred amount of anionic surfactant is about 50%±15%.

Nonionic Surfactant

When additional nonionic surfactants other than the amine oxides are incorporated into the composition, these constituents are advantageously chosen from among the polyethylene glycols having a molecular weight of between 10,000 and 100,000. The utilization of polyethylene glycols is in effect recommended in the case of solid cleaning compositions. However, it has been established that if the molecular weight is less than about 10,000, the compositions obtained do not possess a sufficient hardness, between 0° and 40° C., which represents the range of temperatures at which the products may be stored. When the molecular weight is greater than 100,000 the properties of the obtained compositions are clearly less advantageous with respect to firmness, fusibility, and solubility in water.

On the other hand one "skilled in the art" can determine without the need to conduct undue experimentation, which molecular weight PEG is preferred to be chosen as nonionic surfactant in a particular situation. One can certainly use mixtures of PEG of different molecular weights. For example, when one utilizes an anionic surfactant containing paraffin sulfonates in an amount of 30 to 60% by weight in relation to the total weight of the composition, one either uses PEG of a molecular weight of 20,000 or else one uses PEG of a molecular weight of 20,000 as 60–95% of the total PEG with the remainder of the PEG (40–50%) having a molecular weight of 10,000.

In practice one uses the PEG in an amount of about 10–30%, preferably about 20% by weight of the total composition.

Perfumes

It may be desirable to include within the new compositions, a perfume or a number of perfumes according to the criteria set forth by current market conditions. Those "skilled in the art" can choose the perfume or perfumes as a function of the following two criteria:

(1) its compatibility with active chlorine; and (2) its influence on the physical characteristics of the composition in which it is included.

For example it can be determined that when the composition is present in the form of a solid block, the employment of certain perfumes that can be used together with PEG of a molecular weight a little bit elevated, can be advantageous. For example, replacing PEG of a molecular weight, totally or in part, of between 10,000 and 20,000 with PEG of a molecular weight greater than 35,000 is advantageous when perfume is included in the composition.

Although there is no limiting amount of perfume to be included, it is recommended to use the perfume in a proportion of between 2 and 10%, preferably between 4–8% by weight with respect to the total amount of the composition.

If desired, the compositions according to the present invention, can include other additives, to the extent that no disturbances in each of the active ingredients takes place as a result. For example soap can be included in the composition in an amount of 0.5 to 5% by weight of the total composition and/or salts in a proportion of up to 100% of the total composition together with the essential ingredients mentioned hereinabove.

Tests have been carried out on a number of water closets in order to appreciate the performance obtained with the compositions according to the invention. The performance is determined by the effectiveness of the automatic cleaning of the bowl and by the prevention of fecal waste material from adhering to the walls of the bowl.

The cleaning compositions in the tests have the following ingredients:

| Formula % By Weight | a | b | c | d | e |
|---|---|---|---|---|---|
| Paraffin Sulfonate (Hostapur SAS 93 of Hoechst) | 52 | 53 | 40 | | 55 |
| Alkylbenzene sulfonate | | | | 39 | |
| PEG 10,000 | | | | 19 | |
| PEG 20,000 | 20 | 21.5 | 27.3 | | 20 |
| PEG 35,000 | | | | 14 | |
| Dimethyl dodecyl amine oxide* | 10 | 9 | 10 | 8 | 9 |
| sodium laurate | 1 | 1 | 1 | 1.5 | 1 |
| sodium pyrophosphate | 10 | 10 | 10 | 10 | 10 |
| NaCl | 2.5 | 2.5 | 5 | 2 | 2 |
| $Na_2SO_4$ | | | | 1.5 | |
| Colorant | 2.5 | 3 | 2.5 | 2 | 3 |
| Perfume | | | | 3 | |
| Water | 2 | | 4.2 | | |

*The compound was added as a 30% solution in water or in a water alcohol mixture and the proportions above are for the entire solution.

Some of the water closets have been treated with a composition according to the invention in the form of a solid block, applied with an appropriate distribution apparatus, whereas the remaining water closets were treated with a standard automatic cleaning composition, commercially available having an analogous coloration not distinguishable from the coloration of the tested compositions of the present invention. Applications of the new and prior art compositions were carried out identically. All other cleaning products and cleaning implements were eliminated, so that any inexactitudes due to manual interaction are eliminated so as not to prejudice the tests.

After several days of use, the water closets equipped with the currently available commercial products showed a number of traces of fecal material wherein those water closets treated according to the present invention had either no traces of fecal material or else very small traces which could easily be eliminated by a second flushing of the toilet.

After two weeks use, the status of the surfaces of the toilet bowls treated by the commercially available blocks of composition had to undergo a treatment with an acidic descaling agent to eliminate waste material which adhered to the bowl. When the toilets treated according to the present invention were examined, they remained clean with no necessity to apply the acidic descaling composition.

For the exemplified compositions mentioned hereinabove, each composition effectively maintained the pH of the siphon water of the toilet to be in the range of 6.3±0.5.

The solubility of the compositions as determined in the form of a soluble mass in mg/l of a 3 g sample added to demineralized water at 20° C. for 2.5 hours was respectively for compositions a, b and c: 403, 511 and 436.

The compositions according to the invention can also be prepared in liquid form. In one case, a liquid composition is obtained, by mixing and homogenizing about 3% colorant, 10% of an amine oxide solution (30% aqueous solution), 10% of a pH regulating agent chosen from among those enumerated above (preferably sodium citrate) with the balance water up to 100%; the abovementioned preparations are given as a percentage in terms of weight with respect to the total composition.

In the case of the liquid compositions, it is preferable to distribute them by means of a dosing distribution apparatus using about 0.5 to 1 ml of solution per flush. Accordingly if the siphon has the capacity for a charge of 250–500 ml, this permits assurance with a single application of a composition according to the invention of about 500 flushes.

The abovementioned formulae of the compositions according to the invention has characteristics that are indeed entirely satisfactory.

In a general manner the choice of the compositions according to the invention depends on the desired effective duration of each use, as well as the solubility values and parameters which depend on the mode of dispersion in the flushing water.

We claim:

1. A method of automatically cleaning a toilet bowl which comprises the steps of:

(a) applying to the toilet tank or to the toilet bowl an effective amount for cleaning of a composition which comprises at least one coloring agent which remains stable even in the presence of a chlorine-containing disinfectant, and which further comprises a combination of at least one amine oxide with a pH regulating agent in order to maintain the pH of the resulting aqueous mixture in the toilet bowl at about 6.3±0.5; and (b) forming a protective coating of the amine oxide on the inner walls of the toilet bowl to prevent fecal material as well as the coloring agent from adhering thereto.

2. The method defined in claim 1 which further comprises the application of a chlorine-containing disinfectant to sanitize the toilet bowl.

* * * * *